US005093948A

United States Patent [19]

Val et al.

[11] Patent Number: 5,093,948

[45] Date of Patent: Mar. 10, 1992

[54] PROCESS FOR PREMATURE WEAR OF TEXTILE ARTICLES, MEANS FOR IMPLEMENTING THIS PROCESS, AND TEXTILE ARTICLES THUS PREMATURELY WORN

[75] Inventors: Michel Val, Mouvaux, France; Claude Blankiet, El Paso, Tex.

[73] Assignee: SA Duhamel, Wasquehal Cedex, France

[21] Appl. No.: 596,702

[22] Filed: Oct. 10, 1990

[30] Foreign Application Priority Data

Apr. 10, 1989 [FR] France ..... 89.05073

[51] Int. Cl.[5] ..... D06F 21/02

[52] U.S. Cl. ..... 8/159; 68/29

[58] Field of Search ..... 8/158, 159; 68/13 R, 68/29, 30; 51/164.1, 164.5

[56] References Cited

U.S. PATENT DOCUMENTS 4,750,227 6/1988 Hopkins et al. ..... 68/29 X

FOREIGN PATENT DOCUMENTS 238779 12/1989 European Pat. Off. .
259948 2/1991 European Pat. Off. .
2514793 4/1983 France .
2517710 6/1983 France .
2525644 10/1983 France .
2605024 4/1988 France .

*Primary Examiner*—Philip R. Coe
*Attorney, Agent, or Firm*—Kerkam, Stowell, Kondracki & Clarke

[57] ABSTRACT

The invention relates to a process of premature wear of textile articles. It is characterized in that instead of using bodies 2 of material known for its abrasive power, the articles are agitated with the bodies 2, which over at least a thick peripheral layer if not in totality have a homogeneous structure of relatively flexible material, having a Shore hardness of between 50 and 70, and an index of compression of 55 to 80, and preferably 65 to 70.

8 Claims, 1 Drawing Sheet

Figure 1:
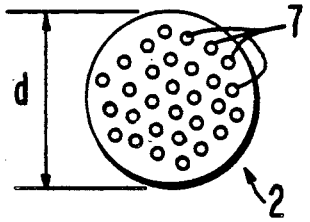

PROCESS FOR PREMATURE WEAR OF TEXTILE ARTICLES, MEANS FOR IMPLEMENTING THIS PROCESS, AND TEXTILE ARTICLES THUS PREMATURELY WORN

The invention relates to a process for premature wear of textile articles, means for implementing this process, and textile articles thus prematurely worn.

More particularly, but not exclusively, it also applies to textile articles made of cotton fabric that has been dyed, and more particularly still to jeans made of blue denim.

After clothing made with this fabric has been used for some time, the surface wear that the clothing undergoes tends to lighten the color naturally.

Fashion, however, dictates that the articles of clothing undergo a premature wear operation before they are used at all, so that they do not look so new; this operation tends to lighten the color artificially.

In all of the nonchemical processes known so far, use has been made of bodies formed at least in part of products known for their abrasive capability, such as sandpaper (European Patent 259948), expanded clay fired at a very high temperature (French Patent 2605024), and the most widely used product, pumice stone (French Patents 2517710 and 2525644 and European Patent 238779).

It is known to line the side face of a rotating drum with this abrasive product (French Patent 2514793), with the clothing articles arranged in the drum along with water in such a way that as the drum rotates the clothing periodically comes into contact with the abrasive liners, which subject the clothing to surface wear.

Unfortunately, the pumice stone crumbles away, and so the linings must be changed frequently, which is very exacting work.

To overcome this disadvantage, the abrasive product has typically been used in the form of pieces, separate from one another, that are mixed with the articles of clothing arranged in the drum.

For example, for premature wear of 100 kg of clothing, 150 kg of pumice stone, broken into pieces approximately 50 mm in diameter are placed with the clothing in the drum of a washing machine, and the entire contents are agitated with the water and optionally some other agent for one or two hours, depending on the type of treatment.

As indicated above, the pumice stone crumbles, and at the end of treatment only approximately 75 kg of pumice stone is recovered; numerous pieces remain in the folds and pockets of the clothing, thus necessitating time-consuming, tedious checking.

The 75 kg of lost pumice stone is drained out along with the wash water, and this crumbled stone has the vexing tendency to plug the filters of water purification plants.

Additionally, the cost of the pumice stone is quite high, although this varies widely depending on the season.

It is also known (French Patent 2525644) to make artificial abrasive elements of powdered pumice stone reconstituted into pieces of various shapes, with the aid of vitrified agglomerants.

Although this limits the crumbling of the abrasive products and the attendant disadvantages mentioned above, it nevertheless remains that considering the abrasive capability of these natural or artificial products and the impact against the articles and the drum caused by rotation, these phenomena will deteriorate the machine and the articles; with respect to the machine, at least the drum must be changed at short intervals, for example after approximately 2 years of use, and even with a drum made of sheet stainless steel this certainly greatly increases the cost price of the treatment.

With respect to the articles, the premature wear is accentuated along the ridges, such as the edges of creases, tags and pockets, and the articles may thus be damaged to the extent that the article of clothing is rejected, or at least set aside for repair.

The use of abrasive beads of spherical form is also known (U.S. Pat. No. 4,750,227); each bead comprises a rigid core of plastic material, such as polypropylene, covered with a variably thick layer of an abrasive substance formed of fibers, of the cross-linked polyester or acrylic type, fixed to the surface of the core with the aid of an adhesive such as an epoxy resin.

Since the polypropylene is a rigid, brittle material, it is not possible to use beads made solely with this material; accordingly it is necessary to cover the core with a layer of a more elastic material.

The manufacture of these elements is very time-consuming and increases the cost price.

Additionally, the bond between the outer layer and the core is not always very strong, and fragments can detach from the core and then either break apart, or damage the walls of the machine.

One object of the invention is a process of premature wear of textile articles that makes use of bodies that after numerous treatments themselves have virtually zero wear, such that they need not be replaced until after very many months or even years of use.

Another object, resulting from the foregoing one, is a process that does not impede the functioning of purification plants.

Another object of the invention is a process that improves the longevity of the machine and does not damage the ridges of the articles, such as the edges of creases, tags and pockets, beyond repair.

To this end, the subject of the invention is a process of the type described above, characterized in particular in that instead of using bodies of material known for its abrasive capability, the articles are agitated with the bodies, which over at least a thick peripheral layer if not in totality have a homogeneous structure of relatively flexible material, having a Shore hardness of between 50 and 70, and an index of compression of 55 to 80, and preferably 65 to 70.

The invention also relates to means for using the process, and the textile articles prematurely worn thereby.

Figure 2:
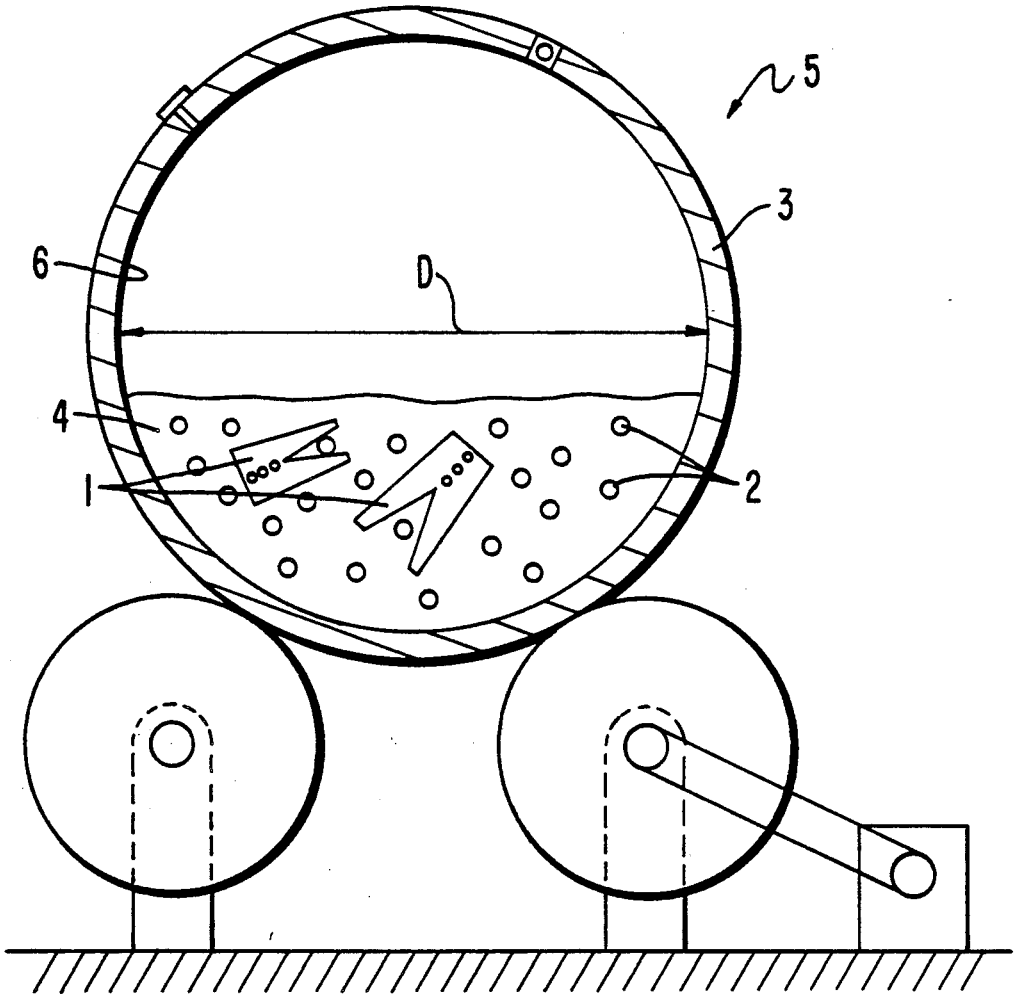

The invention will be better understood from the ensuing detailed description, taken by way of non-limiting example, in conjunction with the drawings, which schematically show the following:

FIG. 1, one of the means for employing the process of the invention;

FIG. 2, a machine, seen in section, during the treatment of textile articles.

In a known manner, for premature wear of textile articles 1, bodies 2 are used that are mixed with the textile articles 1 arranged in a machine, for example a rotating drum 3, and the contents are agitated with water 4 and optionally some other agent for a certain period of time.

In an essential feature of the invention, instead of using bodies 2 of material known for its abrasive power, the articles are agitated with the bodies 2, which over at least a thick peripheral layer if not in totality have a homogeneous structure of relatively flexible material, having a Shore hardness of between 50 and 70, and an index of compression of 55 to 80, and preferably 65 to 70.

For 100 kg of articles to be treated, from 100 to 200 kg of bodies are added, which are agitated for one-half or one hour, depending on the type of treatment, or in other words a time that is only half as long as with pumice stone.

The weight of the bodies is a function of the diameter of the drum.

For a machine 5 having a drum 3 with a diameter D on the order of 1 m 80 cm, from 100 to 120 kg of bodies are sufficient, because their action increases with the height from which they drop.

For a machine 5 of a smaller diameter, the necessary weight of the bodies tends toward 200 kg.

Despite this drop height, the bodies do not threaten to perforate the wall 6 of the drum 3, because shocks are damped by the material comprising it.

The means intended for implementing this process essentially include bodies 2 that over at least a thick peripheral layer if not in totality have a homogeneous structure of relatively flexible material, having a Shore hardness of between 50 and 70, and an index of compression of 55 to 80, and preferably 65 to 70.

This material will for example be an elastomer, such as a polybutadiene.

These bodies 2 preferably have a spherical form, the diameter d of which will be between 35 and 50 mm, and preferably between 40 and 45 mm.

Its weight will be on the order of 40 to 50 g.

They have a smooth side surface, or have pores 7.

In one embodiment, when the bodies 2 are made weights are incorporated in their structure.

These weights comprise either granules of a variably large size, or spirally wound filaments of non-oxidizing material.

For tests, bodies 42.67 mm in diameter, the mean weight of which was 46 g, were used.

The results have proved to be satisfactory.

The articles 1 treated in this way are remarkable in that the ridges are not damaged beyond repair.

We claim:

1. A process of treating textile articles comprising agitating said textile articles in water with a plurality of bodies for a time sufficient to lighten the color of said textile articles and impart premature wear characteristics thereto, substantially the totality of the outer layer of said bodies being composed of a homogenous structure of an elastomeric material, having a Shore hardness of between 50 and 70 and an index of compression of 55 to 80.

2. The process as defined by claim 1 characterized in that for 100 kg of articles to be treated, from 100 to 200 kg of bodies are added, which are agitated for from one-half hour to one hour.

3. The process of claim 2 in which the articles are agitated in a rotating drum.

4. The process of claim 3 wherein said rotating drum has an internal diameter of about 1 m 80 cm and said textile articles are treated with from 100 to 120 kg of said bodies.

5. The process of claim 3 wherein said rotating drum has an internal diameter of less than 1 m 80 cm and the textile articles are treated with about 200 kg of said bodies.

6. The process of claim 1 wherein said bodies have a spherical form, the diameter of which is between 35 and 55 mm, and preferably between 40 and 45 mm.

7. The process of claim 1 wherein the weight of each body is on the order of 40 to 50 g.

8. The process of claim 1 wherein each body has an alveolated side surface.

* * * * *